United States Patent [19]

Brotz

[11] Patent Number: 4,942,504

[45] Date of Patent: Jul. 17, 1990

[54] ELECTROSTATIC DISPLAY DEVICE

[76] Inventor: Gregory R. Brotz, P.O. Box 1322, Sheboygan, Wis. 53081

[21] Appl. No.: 475,910

[22] Filed: Feb. 6, 1990

[51] Int. Cl.[5] ..... F21S 3/00

[52] U.S. Cl. ..... 362/84; 362/806; 362/811

[58] Field of Search ..... 362/84, 260, 806, 811, 362/101

[56] References Cited

U.S. PATENT DOCUMENTS 3,531,635 9/1970 Hancock ..... 362/101
4,072,855 2/1978 Marchese ..... 362/101
4,170,035 10/1978 Walker ..... 362/806
4,744,012 5/1988 Bergkvist ..... 362/84

*Primary Examiner*—Ira S. Lazarus
*Assistant Examiner*—Richard R. Cole
*Attorney, Agent, or Firm*—William Nitkin

[57] ABSTRACT

An electrostatic display device having a plurality of fluorescent particles moving back and forth in a chamber illuminated by blacklight. The chamber having oppositely charged top and bottom plates whereby the particles are alternately electrostatically attracted to and repelled from the plates while illuminated by the blacklight, thus creating a constantly moving decorative light display.

7 Claims, 2 Drawing Sheets

ELECTROSTATIC DISPLAY DEVICE

BACKGROUND OF THE INVENTION

1. Field of the Invention

The device of this invention resides in the area of decorative light displays and more particularly relates to an electrostatic device having dynamic movement of illuminated particles for amusement of the viewer.

2. Description of the Prior Art

Light displays are well known in the prior art such as blinking lights and more recently, laser light displays. Also known in the prior art is the utilization of blacklights which emit ultraviolet rays to illuminate brightly colored flourescent objects.

SUMMARY OF THE INVENTION

It is an object of this invention to provide an electrostatic device which utilizes a blacklight in association with a viewing chamber to illuminate a multiplicity of moving florescent particles within the chamber to produce a visual display.

One embodiment of the device of this invention provides a chamber having at least one transparent side with a plurality of electrostatic plates disposed therein surrounding a blacklight fluorescent bulb. A plurality of apertures are disposed within the plates. A large plurality of fluorescent particles are moved electrostatically within the chamber, such particles being illuminated by the blacklight to create an exciting and dynamic visual display. In another embodiment, the viewing chamber extends from a chamber containing the electrostatically charged plates and a black light source shines light into such viewing chamber against the moving fluorescent particles.

DESCRIPTION OF THE PREFERRED EMBODIMENT(S)

Figure 1:
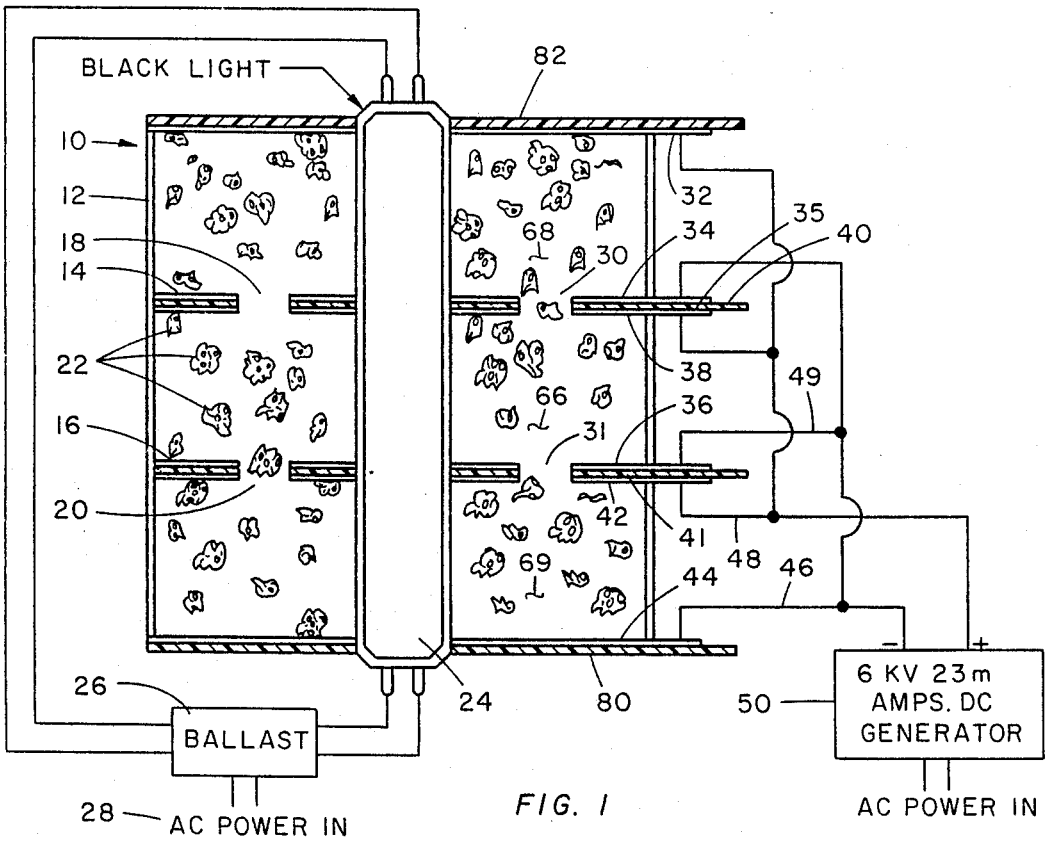
FIG. 1 illustrates a cross-sectional view through the electrostatic display device of this invention.
Figure 3:
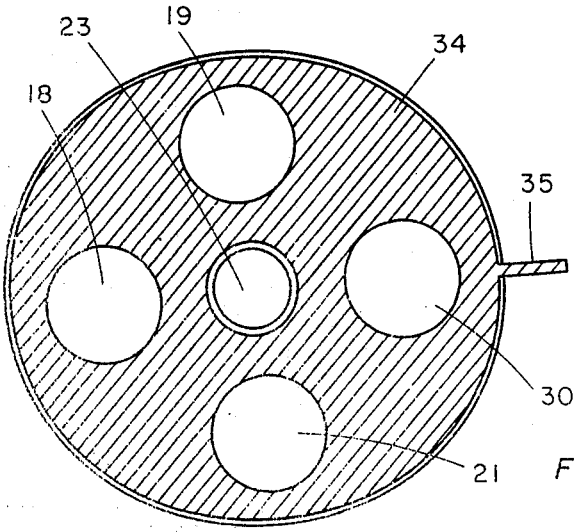
FIG. 3 illustrates a top view of an electrostatic plate.

FIG. 1 illustrates a cross-sectional view through the electrostatic display device of this invention. Seen in this view is chamber 10 which has transparent side 12 and has disposed extending vertically in the center thereof fluorescent blacklight 24 which is powered through ballast 26 from AC power source 28. Seen in this embodiment utilizing two electrostatic plates are first electrostatic plate 14 and second electrostatic plate 16 each having a plurality of apertures defined therein, the central aperture 23 of each electrostatic plate for receipt therethrough of blacklight 24. Other apertures are arrayed through the electrostatic plates which electrostatic plates in the embodiment illustrated are generally disposed perpendicular to vertically disposed blacklight 24. The cross-sectional view of FIG. 1 cuts through two of the apertures in first electrostatic plate 14 being apertures 18 and 30. Also seen in FIG. 1 are apertures 20 and 31 in second electrostatic plate 16. FIG. 3, showing a top view of first electrostatic plate 14, illustrates other apertures formed therein such as apertures 19 and 21 which are not seen in the cross-sectional view of FIG. 1. Each electrostatic plate has disposed above and below its central electrically insulative core an electrically conductive surface such as first electrostatic plate 14 showing top electrically conductive surface 34 and bottom electrically conductive surface 38 disposed on either side of central core 40. These electrically conductive surfaces extend over each side of the planar surfaces of the electrostatic plates and then also extend out of chamber 10 through transparent side 12 where electric wires can be attached thereto.

Figure 2:
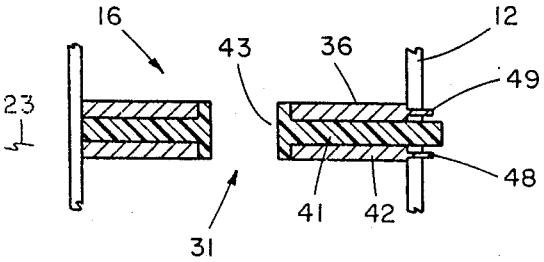
FIG. 2 illustrates a partial cross-sectional view of an electrostatic plate showing its electrical connections.
Figure 4:
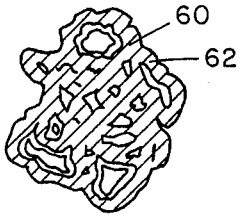
FIG. 4 illustrates an enlarged view of a particle coated with fluorescent paint.

FIG. 2 illustrates a partial cross-sectional view of second electrostatic plate 16 extending from blacklight 24. Seen in this view is top electrically conductive surface 36 and bottom electrically conductive surface 42 surrounding central plate core 41 which core 41 can be non-conductive and helps support second electrostatic plate 16 in position. Around each aperture, such as aperture 31 in FIG. 2, core 41 extends upwards and downwards to form an insulative wall 43 around the inside of each aperture to help allow the particles to easily pass therethrough. Extending out beyond side 12 of chamber 10 are electrical leads 48 and 49 which connect to a 6000 volt 23 milliamps DC generator 50 which static charge generator is also interconnected to all of the other electrically conductive surfaces with the upper elecrtrically conductive surface of each section of the chamber such as section 64, 66, and 68 having a positive-charge electrically conductive surface and such sections also having a negatively charged electrically conductive surface at the bottom thereof. Bottom 80 and top 82 of chamber 10 also have charged electrically conductive surfaces conforming to having a positive charge at top 82 and a negative charge at bottom 80. Between such sections such as sections 64, 66 and 68 are apertures formed in the electrostatic plates such as apertures 31 and 30. Within chamber 10 is placed a multiplicity of small particles capable of holding an electrostatic charge such as aluminum particles or equivalent which have been coated with fluorescent paint. A coated particle is seen enlarged in FIG. 4 showing aluminum particle 60 coated with fluorescent paint 62. These small particles are extremely lightweight and even when coated with fluorescent paint are easily moved toward the electrically charged surfaces to which they are attracted.

Figure 5:
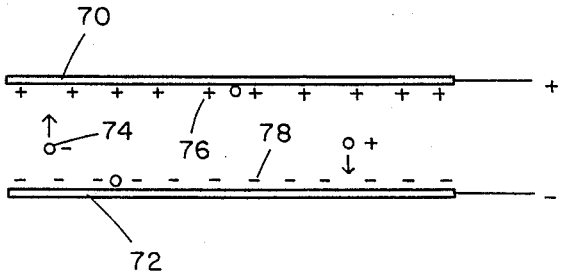
FIG. 5 illustrates the attraction/repulsion of electrostatically charged particles between electrostatic plates.

The device in operation, as seen in FIG. 5, carries negative charge 78 on the lower plate of each chamber section as lower 72 and positive charge 76 on upper plate 70. When the device is not operating, particles 74 rest on the bottom and when the device is turned on, the particles take on the negative charge of lower plate 72. Since the particles and lower plate 72 are then of the same charge, particles 74 are repelled and at the same time attracted by the positive charge 76 of upper plate 70 so that the particles move upwards. Then the negative charge on particles 74 dissipates and particles 74 acquire the positive charge 76 of upper plate 70 upon contact therewith. This positive charge on particles 74 then causes particles 74 to be repelled from top plate 70 back downward to negatively charged lower plate 72.

This process continues with the particles being attracted and then repelled an so on causing the particles to be constantly in motion between the top and bottom plates of the chamber's sections. Some of the particles pass through the series of apertures in the electrostatic plates such as apertures 18 and 30 and move from one chamber section to another such as from chamber setion 64 to chamber section 66 and then to chamber section 68. The particles move up and down within each section and within the entire chamber and through the apertures, bouncing back and forth between the electrostatic plates and passing at times through the apertures. When the particles are illuminated by blacklight 24, a display of moving fluorescing particles is created. The particles can be coated with different fluorescent colors, for example some particles can be red, blue or yellow as desired.

Figure 6:
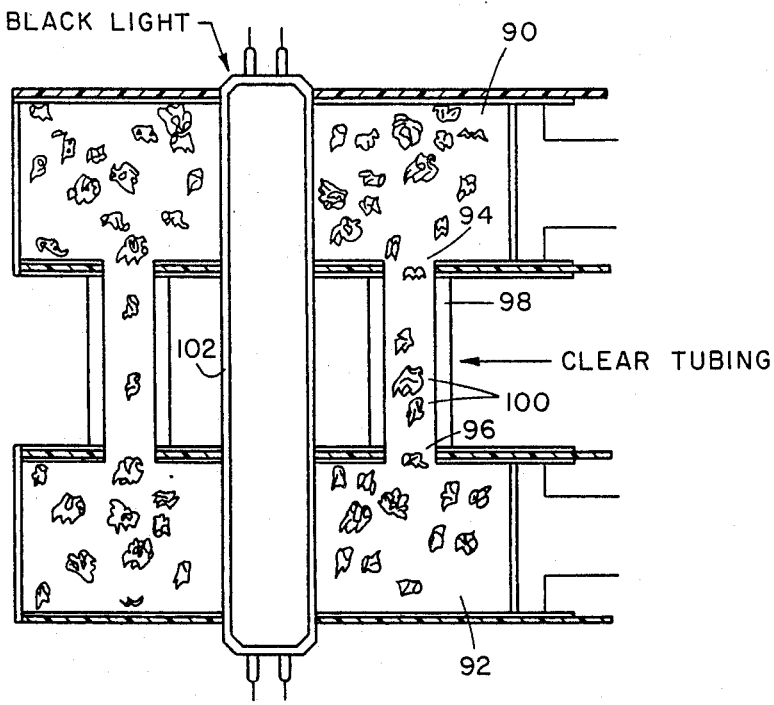
FIG. 6 illustrates a cross-sectional view through an alternate electrostatic display device.
Figure 7:
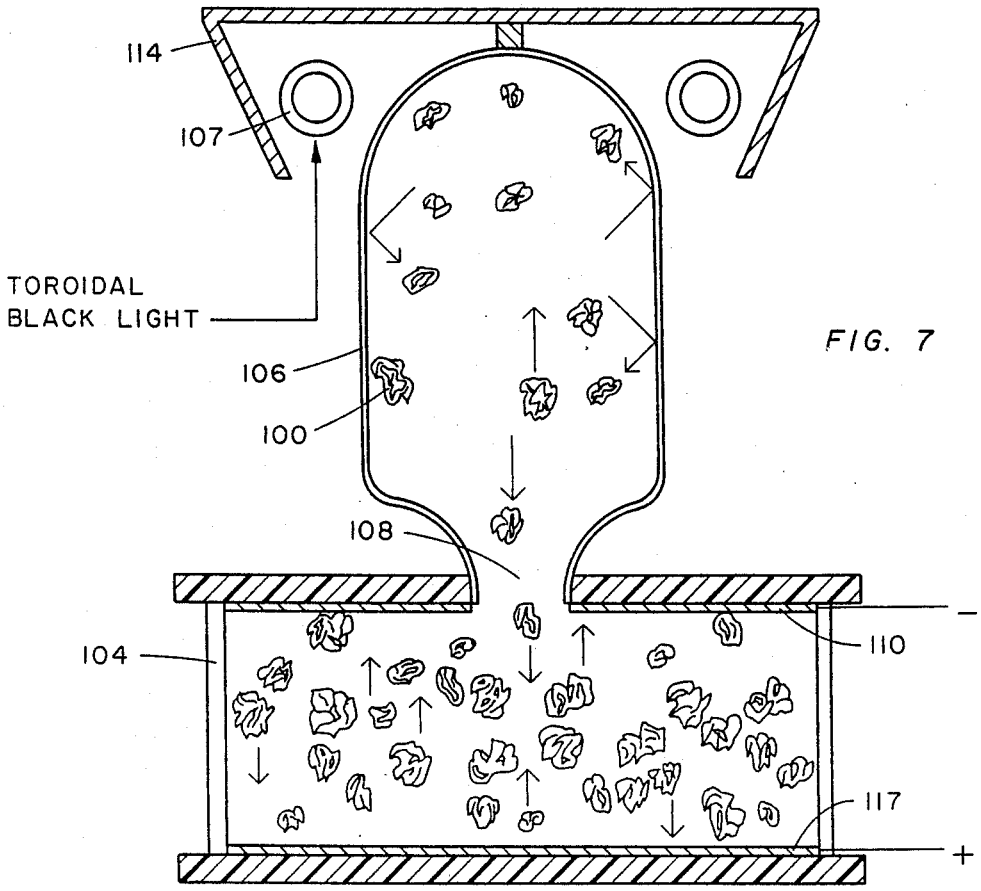
FIG. 7 illustrates a cross-sectional view through an alternate electrostatic display device with separate plate chamber and viewing chamber.

FIG. 6 illustrates an alternate embodiment where upper chamber 90 and lower chamber 92 are separated at their corresponding plate apertures such as apertures 94 and 96 by elongated clear tubes 98 through which particles 100 pass and are illuminated by black light 102. A further alternate embodiment is shown in FIG. 7 illustrating that the chamber with charged plates 104 can be separated from viewing chamber 106 and that black light 107 can be external of both charged plate chamber 104 and viewing chamber 106. In the embodiment of FIG. 7 an aperture 108 is provided in one of the charged plates through which aperture particles 100 can bounce as they are repelled back and forth between plates 110 and 112. Some particles will, by chance, pass through aperture 108 and bounce around in transparent viewing chamber 106. Circular fluorescent black kight 107 can be disposed above viewing chamber 106 to illuminate the particles bouncing around therein. When the particles lose their momentum, they fall back through aperture 108 to start being repelled between plates 110 and 112 until the particles again pass through aperture 108 back into viewing chamber 106. A shield 114 can be placed around black light 107 to shield the viewer's eyes and to reflect more of the black light into viewing chamber 106.

Although the present invention has been described with reference to particular embodiments, it will be apparent to those skilled in the art that variations and modifications can be substituted therefor without departing from the principles and spirit of the invention.

I claim:

1. An electrostatic display device comprising:

a viewing chamber having at least one transparent side;

an upper electrostatic plate having an electric charge;

a lower electrostatic plate having an opposing charge from the charge of said upper electrostatic plate;

means for producing blacklight to illuminate said viewing chamber;

a plurality of electrostatically charged fluorescent particles; and means for generating an electric current to said upper and lower electrostatic plates causing said particles to be attracted to the electrostatic plate opposite of said particles, said particles acquiring the charge of such electrostsatic plate to be then repelled and attracted to said electrostatic plate of opposing charge where said particles then change their charge to the same charge of that electrostatic plate where said particles are again repelled and attracted to the electrostatic plate of opposing charge, such process of changing charges continuing, causing the particles to move within said chamber as said particles are illuminated by said blacklight.

2. The device of claim 1 wherein said chamber includes a plurality of sections, each section having oppositely charged electrostatic plates at its top and bottom, said electrosratic plates having a plurality of apertures defined therein, said particles not only move between said electrostatic plates but also pass through said apertures as they move from section to section within said chamber.

3. The device of claim 2 wherein said means to produce blacklight includes a blacklight fluorescent tube vertically disposed in the center of said chamber extending through selected of said apertures defined in said electrostatic plates.

4. The device of claim 3 further including transparent tubes interconnecting said sections, said tubes aligned and interconnected with said plates at selected of said apertures in said electrostatic plates for said particles to pass through said transparent tubes when passing from section to section through said apertures.

5. The device of claim 1 wherein said device further includes a plate chamber containing said upper and lower electrostatic plates with said viewing chamber being disposed adjacent to said plate chamber further including an aperture defined between said plate chamber and said viewing chamber to allow passage of said moving particles therethrough from said plate chamber to said viewing chamber and vice versa.

6. A method of creating an electrostatic light display, comprising the steps of:

providing a plate chamber having oppositely charged electrostatic plates at its top and bottom;

providing a source of blacklight;

providing a plurality of fluorescent particles capable of holding an electric charge and fluorescing when illuminated by said blacklight;

attracting said charged particles to the electrostatic plate of opposite charge;

changing the charge of said particles to be the same as the electrostatic plate to which they have benn attacted;

repelling said like-charged particles from said then like-charged electrostatic plate to said oppositely charged electrostatic plate;

repeating said attraction and repulsion process causing said particles to move back and forth within said chamber; and illuminating said moving particles by said blacklight.

7. The method of claim 6 further including the step of:

allowing particles to escape from said plate chamber to bounce around in a viewing chamber where said particles are illuminated by said blacklight.

* * * * *